US010890322B2

(12) United States Patent
Skovbo et al.

(10) Patent No.: US 10,890,322 B2
(45) Date of Patent: Jan. 12, 2021

(54) COMBI STOVE AND USE OF A COMBI STOVE

(71) Applicant: ADURO A/S, Hasselager (DK)

(72) Inventors: Christian Skovbo, Aarhus C (DK); Kim Gregersen, Brønderslev (DK)

(73) Assignee: Aduro A/S, Hasselager (DK)

( * ) Notice: Subject to any disclaimer, the term of this patent is extended or adjusted under 35 U.S.C. 154(b) by 21 days.

(21) Appl. No.: 16/465,261

(22) PCT Filed: Dec. 18, 2017

(86) PCT No.: PCT/DK2017/050437

§ 371 (c)(1),
(2) Date: May 30, 2019

(87) PCT Pub. No.: WO2018/113881

PCT Pub. Date: Jun. 28, 2018

(65) Prior Publication Data

US 2019/0390853 A1 Dec. 26, 2019

(30) Foreign Application Priority Data

Dec. 20, 2016 (DK) ..... 2016 071007

(51) Int. Cl.
*F23B 40/04* (2006.01)
*F23B 60/02* (2006.01)
(Continued)

(52) U.S. Cl.
CPC ..... *F23B 40/04* (2013.01); *F23B 60/02* (2013.01); *F23G 5/008* (2013.01); *F23K 3/14* (2013.01);
(Continued)

(58) Field of Classification Search
CPC ..... F23B 40/04
See application file for complete search history.

(56) References Cited

U.S. PATENT DOCUMENTS 2,198,710 A 4/1940 Turner
3,727,746 A * 4/1973 Slusher ..... B65G 33/02 198/659
(Continued)

FOREIGN PATENT DOCUMENTS

AT 006000 U1 2/2003
DE 102005049276 A1 * 4/2007 ..... F24B 1/024
(Continued)

OTHER PUBLICATIONS

DE102005049276A1—machine translation (Year: 2005).*
(Continued)

*Primary Examiner* — Nathaniel Herzfeld
(74) *Attorney, Agent, or Firm* — Blank Rome LLP

(57) ABSTRACT

Disclosed is a stove (1) arranged for combusting granular material. The stove (1) comprises a granular material combustion area (5) including a bottom combustion surface (6) and granular material feeding means (15) arranged for feeding granular material up into the granular material combustion area (5) from a granular material storage (16) arranged beneath the granular material combustion area (5), wherein the granular material feeding means (15) comprises a curving auger (21). Furthermore, a use of a stove (1) is disclosed.

17 Claims, 5 Drawing Sheets

Figure 2:
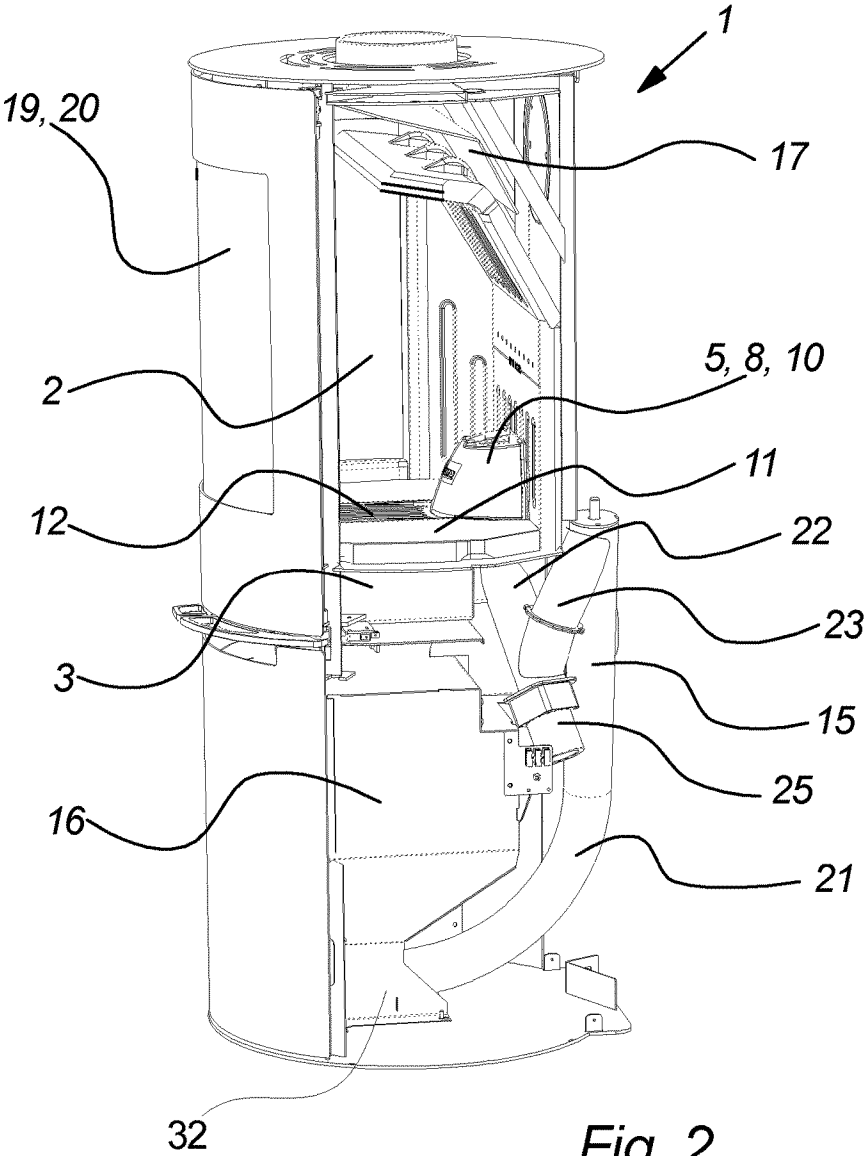

(51) Int. Cl.

| | |
|---|---|
| *F23G 5/00* | (2006.01) |
| *F23K 3/14* | (2006.01) |
| *F24B 1/02* | (2006.01) |
| *F24B 1/195* | (2006.01) |
| *F24B 13/04* | (2006.01) |

(52) U.S. Cl.
CPC ..... *F24B 1/026* (2013.01); *F24B 1/1952* (2013.01); *F24B 13/04* (2013.01)

(56) References Cited

U.S. PATENT DOCUMENTS 4,574,712 A * 3/1986 David ..... F23K 3/14 110/101 R
4,856,438 A * 8/1989 Peugh ..... F24B 13/04 110/233
5,001,993 A * 3/1991 Gramlow ..... F23B 1/30 110/110
5,269,233 A * 12/1993 Johnson ..... F23J 1/06 110/101 CF
5,680,855 A * 10/1997 Ko ..... F24B 1/1885 126/68
2011/0048398 A1* 3/2011 Christensen ..... F23B 10/00 126/77
2011/0120354 A1 5/2011 Riemens et al.

FOREIGN PATENT DOCUMENTS

| | | | |
|---|---|---|---|
| EA | 201201053 | A1 | 12/2012 |
| EP | 2500650 | A2 | 9/2012 |
| GB | 481156 | | 3/1938 |
| JP | 56-144941 | | 3/1955 |
| JP | 2002-221307 | A | 8/2002 |
| JP | 2016-006366 | A | 7/2016 |
| SE | 523090 | C2 | 3/2004 |
| WO | WO-2009146935 | A2 | 12/2009 |

OTHER PUBLICATIONS

International Search Report & Written Opinion for PCT/DK2017/050437, dated Apr. 5, 2018, 12 pages.
International Preliminary Report on Patentability for PCT/DK2017/050437, dated Nov. 20, 2018, 5 pages.

* cited by examiner

COMBI STOVE AND USE OF A COMBI STOVE

RELATED APPLICATIONS

This application is a national phase of PCT/DK2017/050437, filed on Dec. 18, 2017, which claims priority to Denmark Patent Application No. PA 2016 71007, filed on Dec. 20, 2016. The entire contents of these applications are hereby incorporated by reference.

FIELD OF THE INVENTION

The invention relates to a stove arranged for combusting granular material. The invention further relates to use of a stove.

BACKGROUND OF THE INVENTION

Stoves for combusting granular material such as wood pellets are becoming more and more popular because the uniform combustion material enables a more uniform, controllable, efficient and cleaner combustion.

But a pellet stove has the major drawback that it needs a substantially constant supply of pellets during the combustion process and therefore also needs a relatively large pellet storage close to the stove, which causes pellet stoves to typically be large and bulky.

Thus, from US 2011/0120354 A1 it is known to arrange the pellet storage beneath the combustion chamber of a pellet furnace so that the combustion device may be formed more compact and space-efficient. But this requires an auger design that is very sensitive to the uniformity of the granular material and this auger design entails that the pellet storage can never be fully emptied which causes unwanted dust buildup in the storage. Furthermore, the risk of back burning igniting the entire pellet storage is increased.

It is therefore an object of the present invention to provide for a stove arranged for combusting granular material that has a safer and more efficient design.

THE INVENTION

The invention provides for a stove arranged for combusting granular material. The stove comprises a granular material combustion area including a bottom combustion surface and granular material feeding means arranged for feeding granular material up into the granular material combustion area from a granular material storage arranged beneath the granular material combustion area, wherein the granular material feeding means comprises a curving auger.

Feeding the granular material to the combustion area by means of a curving auger allows that the granular material may be drawn from beneath the bottom of the storage and then transported in a curve upwards towards the combustion area. This is advantageous in that the storage hereby can be completely emptied thus avoiding dust build-up in the storage tank and a more efficient use of the limited space beneath the combustion chamber. Also, the by drawing the granular material from beneath the bottom of the storage the bottom of the storage only has to slope a little to ensure that all the content will be directed towards the exit opening as the storage is emptied.

Furthermore, feeding the granular material upwards into the granular material combustion area from below is advantageous in that this allows for a simpler design of the combustion chamber, it forms a more durable design because the granular material feeding means is more protected and it is avoided that dropping granular material and the granular material feeding means themselves will influence the combustion process compared to if the granular material was fed from above.

In this context the term "granular material" should be understood as any kind of pellet, grain, coarse or other a small particle material formed by wood, cereal, nut shells, paper or other or any combination thereof or any other kind of small particle material suitable for acting as combustion material in what is commonly known as a pellet stove.

It should also be emphasised that the term "granular material feeding means" in this context should be understood as any kind of granular material feeder suited for feeding granular material to a granular material combustion area—i.e. any kind of screw conveyer, auger, belt conveyer, chain conveyer or other or any combination thereof.

In an aspect of the invention, the curving auger comprises a centreless helical element.

To enable that the auger can transport material through a curve the centre shaft could be flexible, it could comprise a number of joints—e.g. universal joints—or other. However, forming the helical element (also called a volution) of the curving auger without a centre shaft provides for a simple and inexpensive auger design. Furthermore, the shaftless design allows for a more flexible helical element which in turn entail a less noisy operation in that the flexible quality will allow the helical element to occasionally pass some of the granular material instead of crushing it against the outer tube if the helical element was stiff and rigid.

In an aspect of the invention, the curving auger curves from a predominantly horizontal transport direction at a bottom of the granular material storage to a predominantly vertical transport direction.

A curving auger that curves from a predominantly horizontal transport direction at a bottom allows that the pellets may drop down into the auger from a top side thus ensuring that the auger is substantially completely filled. This is advantageous in that it ensures efficient operation and it reduces the risk of back burning when the auger is full of granular material. And it is advantageous that the auger curves to a predominantly vertical transport direction in that the curving auger hereby can feed directly up into the combustion area or it can deliver the material to another feeding device that will only have to transport the material a short distance.

In an aspect of the invention, the granular material feeding means further comprises an upper auger.

Hereby is achieved an advantageous embodiment of the invention.

In an aspect of the invention, the curving auger is arranged to deliver granular material to the upper auger through a down duct.

Arranging a down duct between the curving auger and the upper auger is advantageous in that it reduces the risk of back burning.

In an aspect of the invention, a helical element of the upper auger is arranged on a centre shaft extending substantially the full length of the helical element.

A centreless auger emits less noise and is easier to suspended due to its flexible quality. But when feeding granular material directly to the combustion site in a pellet stove the upper end of the auger becomes very hot—particularly during a power outage—and the risk of calcine, heat deformation or other is pronounced. Forming the upper auger with a centre shaft reduces the risk of heat damaging or effecting the functionality of the auger.

In an aspect of the invention, the outer periphery of the granular material storage is equal to or fully enclosed within the outer periphery of a combustion chamber of the stove as seen in a horizontal plane.

Herby it is possible to form a slender and space-efficient stove.

In an aspect of the invention, the bottom combustion surface comprises bottom airflow apertures arranged to enable an airflow to the granular material during a combustion of the granular material in the granular material combustion area.

Feeding air from the underside at the combustion site is advantageous in that this will support the combustion process and at the same time aid in guiding ash and other foreign objects away from the combustion site.

In an aspect of the invention, the stove comprises airflow generating means for actively generating an airflow through the bottom airflow apertures at least during a combustion of the granular material.

Actively generating an airflow to the combustion area of the granular material is advantageous in that it hereby is possible to generate a more efficient and clean combustion.

It should be emphasised that the term "airflow generating means" in this context should be understood as any kind of airflow generator suited for actively generating an airflow—i.e. any kind of motor driven fan, blower, ventilation device or other or any combination thereof.

In an aspect of the invention, the stove is a combi stove arranged for combusting both logs and granular material and wherein the stove comprises a log combustion area.

A pellet stove has two major drawbacks in relation to conventional wood burning stoves—in which wood logs or briquettes are the primary combustion material. A pellet stove requires electricity to initiate the combustion process, to feed pellets to the combustion area, to actively generate an airflow to the combustion area etc. so a pellet stove cannot (or is at least very difficult to) operate without electricity. Furthermore, the pellet combustion process is typically noisier—noise being generated by the active airflow, the pellet feeding system or other—and the combustion process in a pellet stove is typically not at pleasing and calming to watch as a combustion process in a wood burning stove.

It is therefore advantageous to provide the stove with a log combustion area so that the most suitable combustion process can be chosen for every occasion.

It should be emphasised that the term "log" is to be understood as any kind of larger wood piece, briquette, chopped wood or similar larger combustion material suited for being combusted in a wood burning stove. Although the term "log" is commonly used in relation with wood, the term is in this context not restricted entirely to wood, in that the log could be made from other combustible materials—either hole or compressed—such as other plant material, paper or cardboard material or other.

In an aspect of the invention, the stove further comprises a front aperture through which logs may be placed in the log combustion chamber.

Hereby is achieved an advantageous embodiment of the invention.

In an aspect of the invention, the log combustion area is arranged between the front aperture and the granular material combustion area.

Forming the log combustion area in front of the granular material combustion area—as seen from the front aperture—is advantageous in that this will provide free space for arranging the logs in the combustion chamber and it will reduce the risk of the logs covering the granular material combustion area and thereby hinder the use or functionality of the granular material combustion.

In an aspect of the invention, the stove comprises ash collecting means arranged under the log combustion area and wherein the log combustion area is separated at least partly from the ash collecting means by means of a grate.

Separating at least a part of the log combustion area from the ash collecting means by means of a grate is advantageous in that only when combusted and turned into ash, the log combustion material can pass through the separation grate and the grate enables that air may flow freely to the combustion process from the underside.

In this context the term "ash collecting means" should be understood as any kind of ash collector suitable for collecting ash generated by the combustion processes in a combi stove—i.e. any kind of tray, salver, drawer, suction device or similar.

In an aspect of the invention, the grate and the bottom combustion surface are substantially level.

Forming the stove so that the grate and the bottom combustion surface are substantially level is advantageous in that this enables that ash, slag or other on the bottom combustion surface may easily be swept or pushed out onto the grate where it will continue down into the ash collecting means.

It should be emphasised that the term "substantially level" in this context should not be limited to the grate and the bottom combustion surface being completely flush or even being parallel. In this context the term is to be understood as the grate and the bottom combustion surface being generally or roughly arranged in the same level, enabling that ash, slag or other on the bottom combustion surface may easily be moved out onto the grate.

In an aspect of the invention, the combi stove comprises flue means arranged above the combustion chamber.

Arranging the flue means above the combustion chamber provides for a space and energy efficient stove design.

It should be emphasised that the term "flue means" in this context should be understood as any kind of flue suited for guiding the flue gases out of the stove while transferring the heat of the flue gasses to the stove—i.e. any kind of piping, flue maze, plate arrangement or other or any combination thereof.

The invention further provides for use of a stove according to any of the previously described stoves for combusting wood pellets.

Wood pellets is an inexpensive, uniform and energy-rich material that is particularly suited as fuel in a stove according to the present invention.

FIGURES

Figure 1:
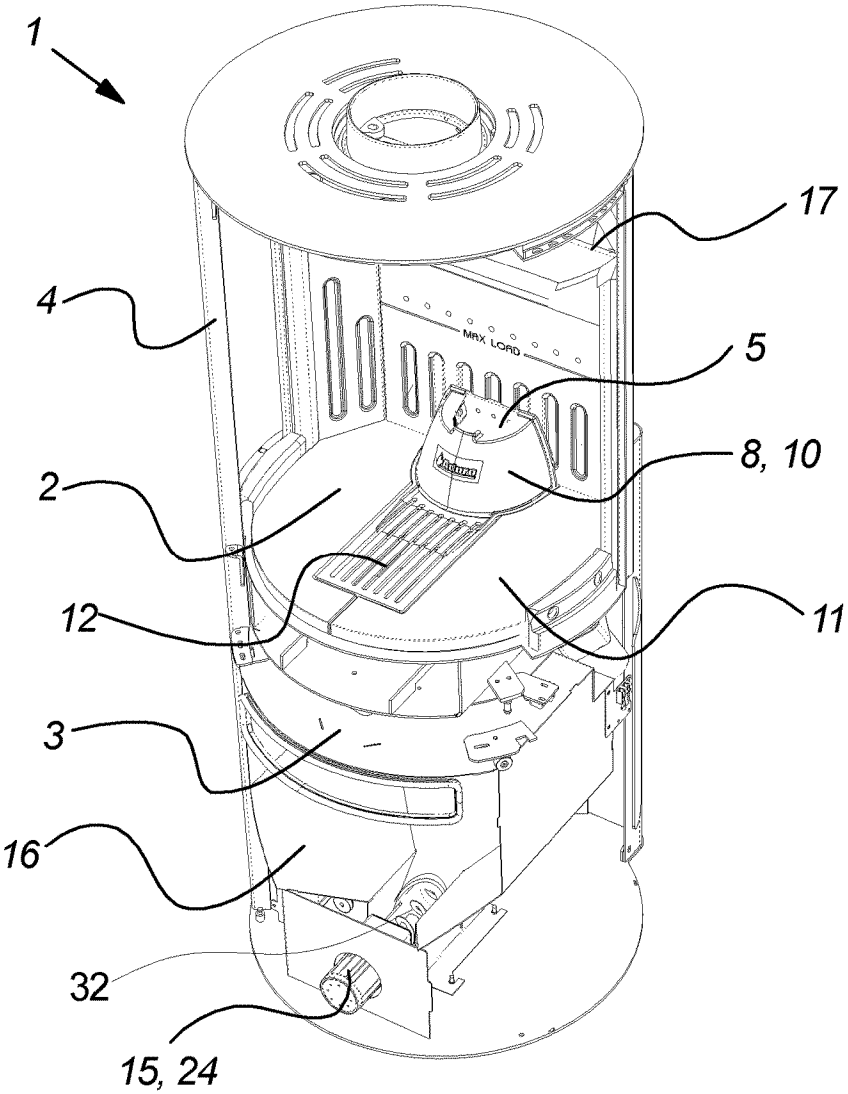
Figure 4:
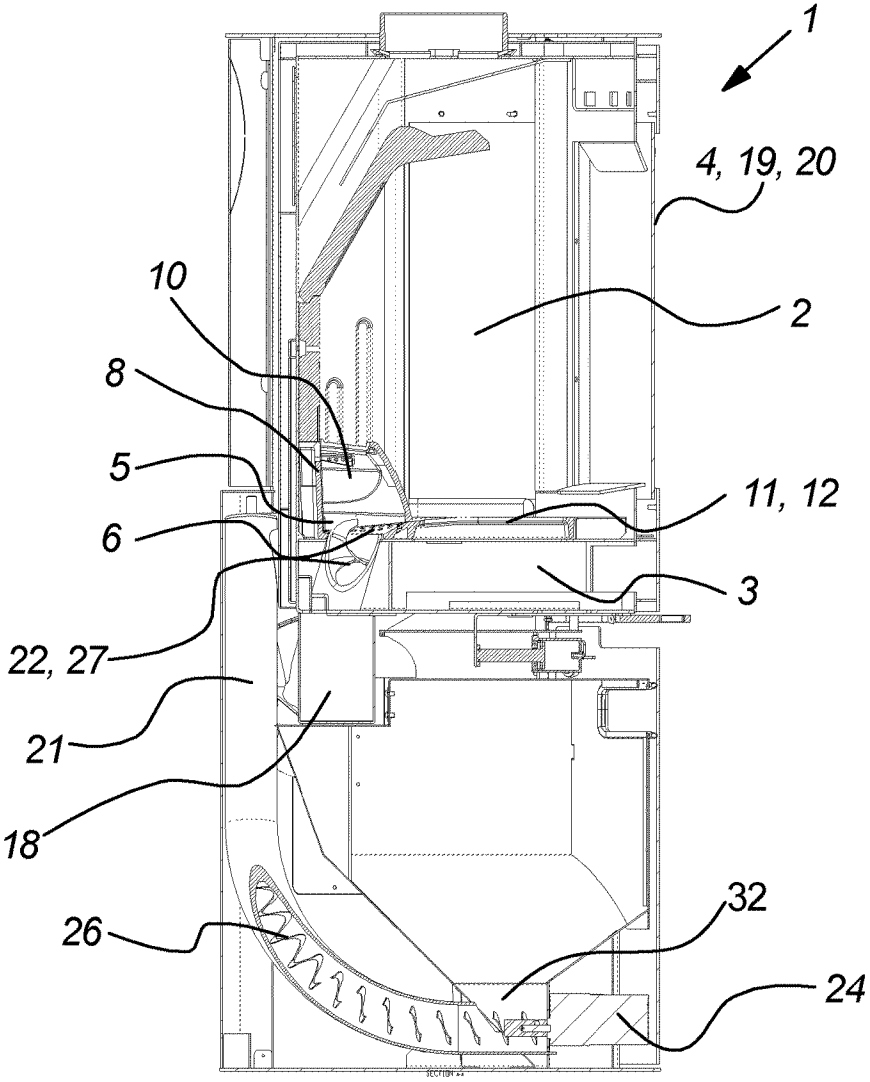
Figure 3:
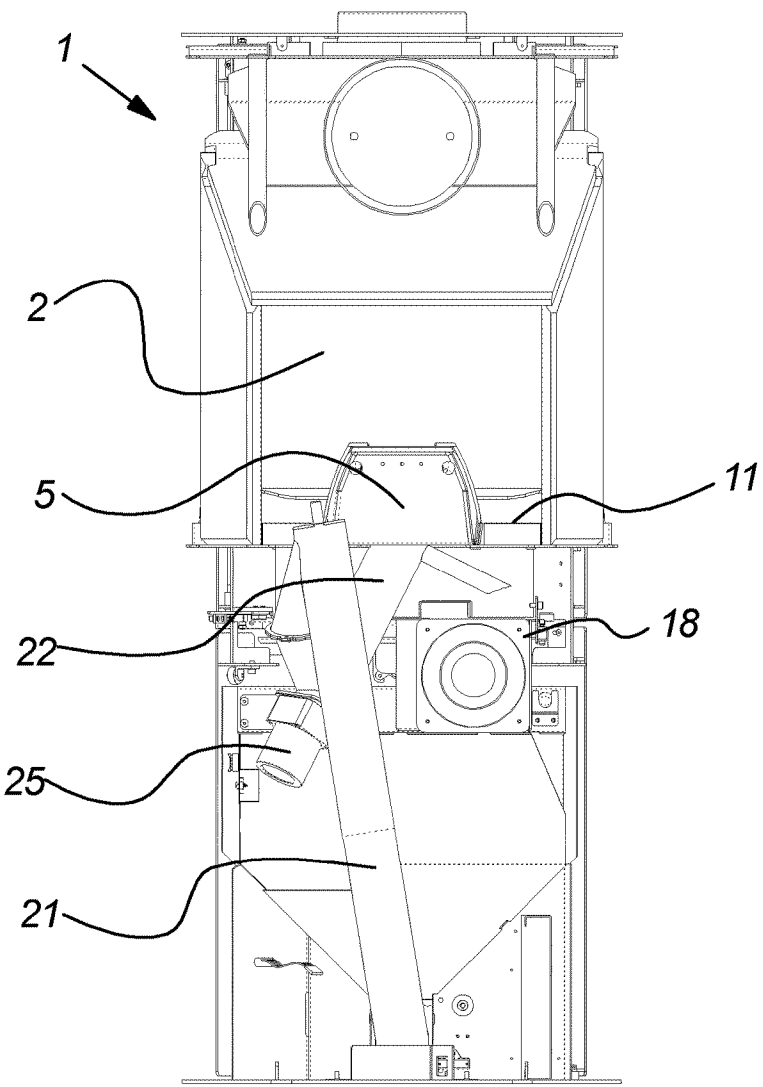
Figure 5:
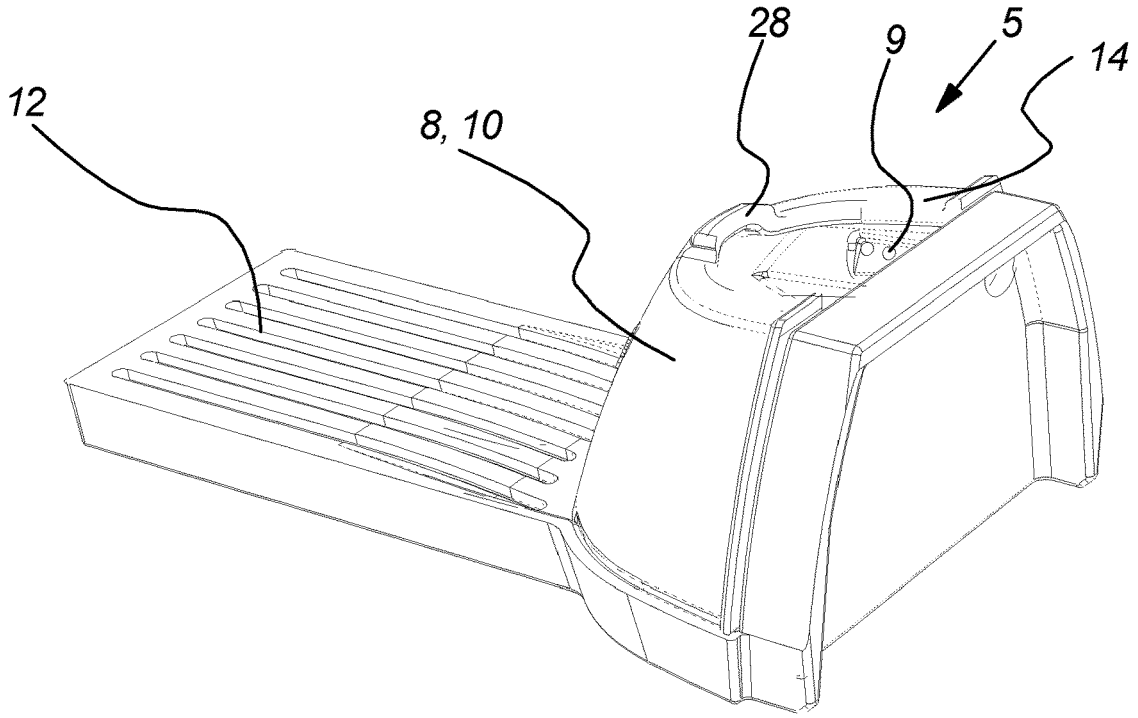
Figure 6:
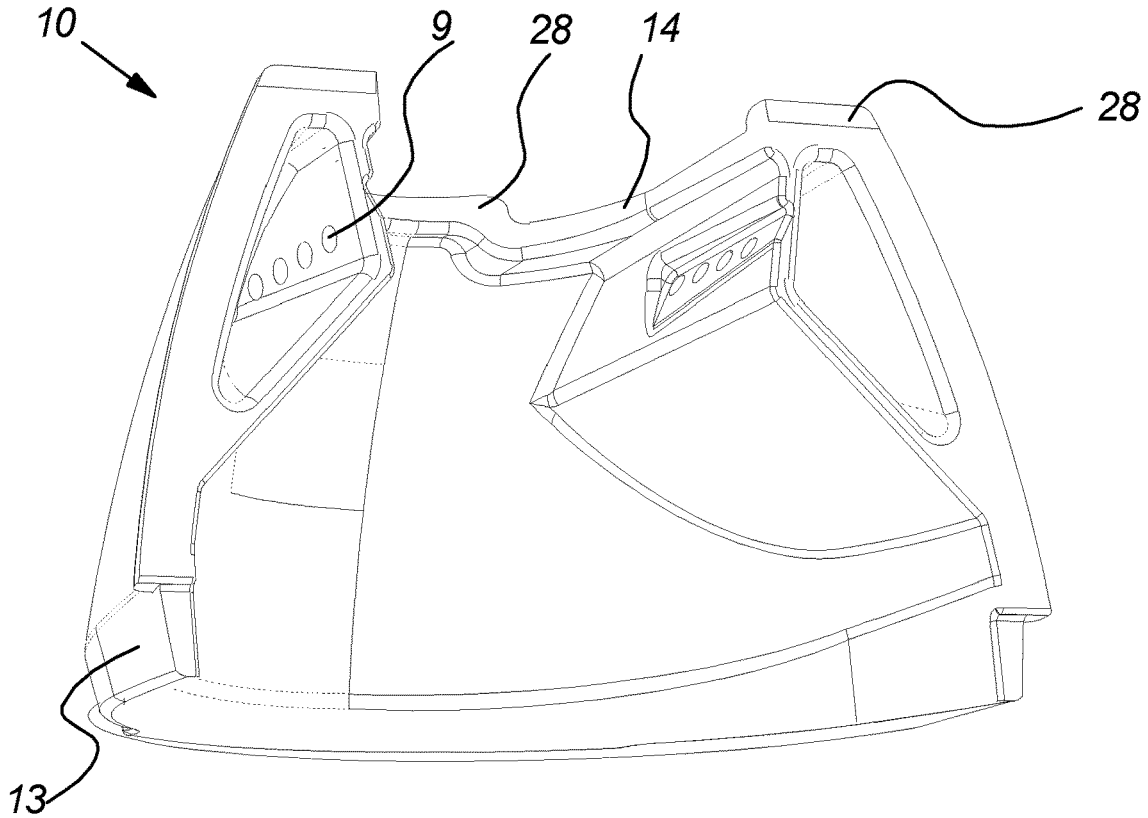
Figure 7:
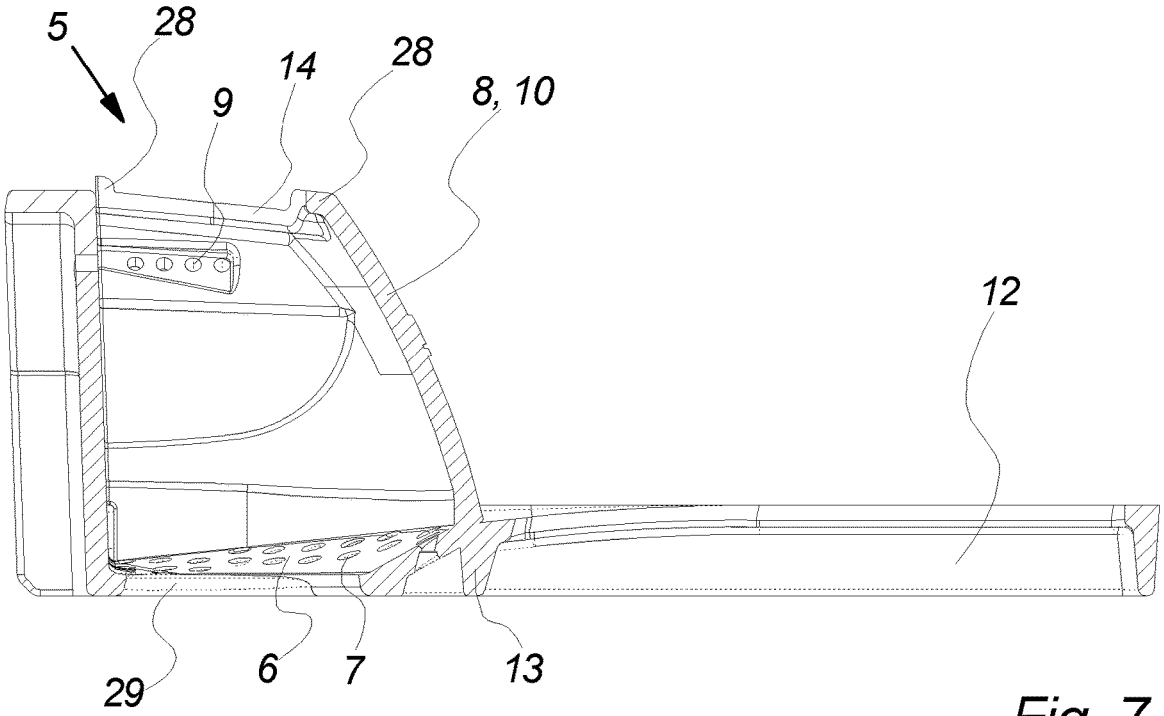
Figure 8:
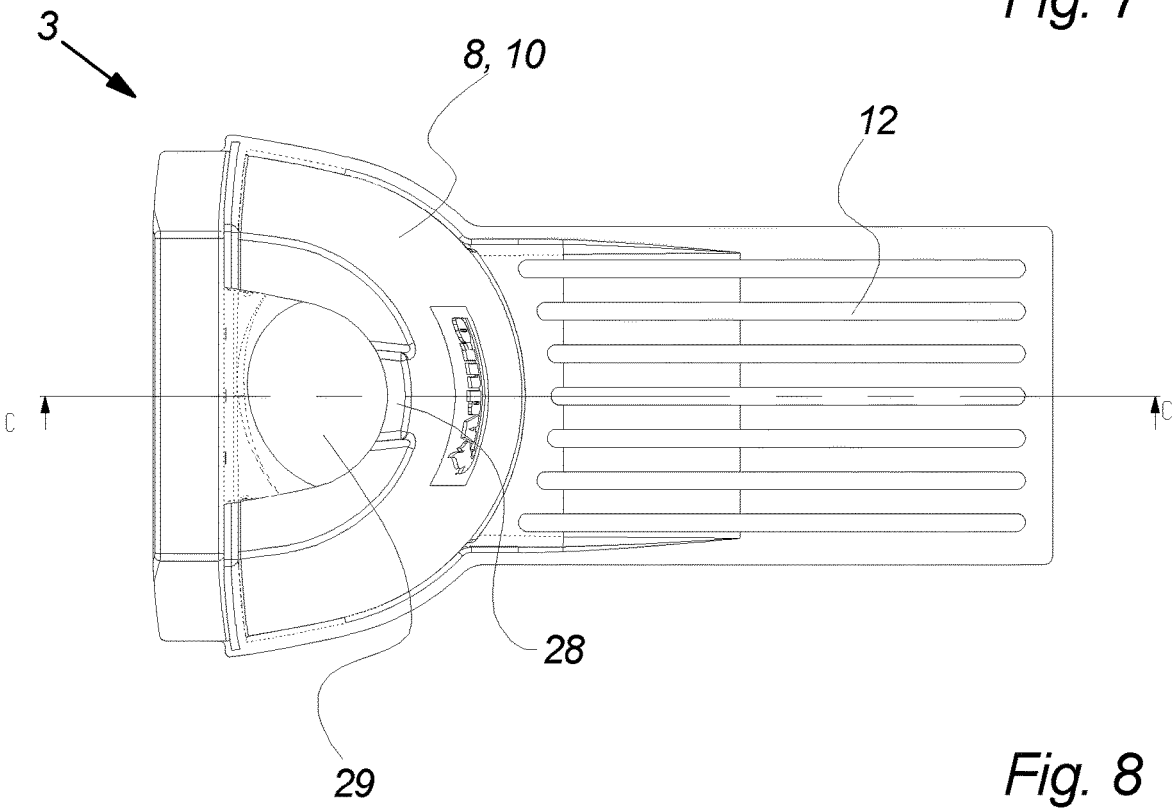
Figure 10:
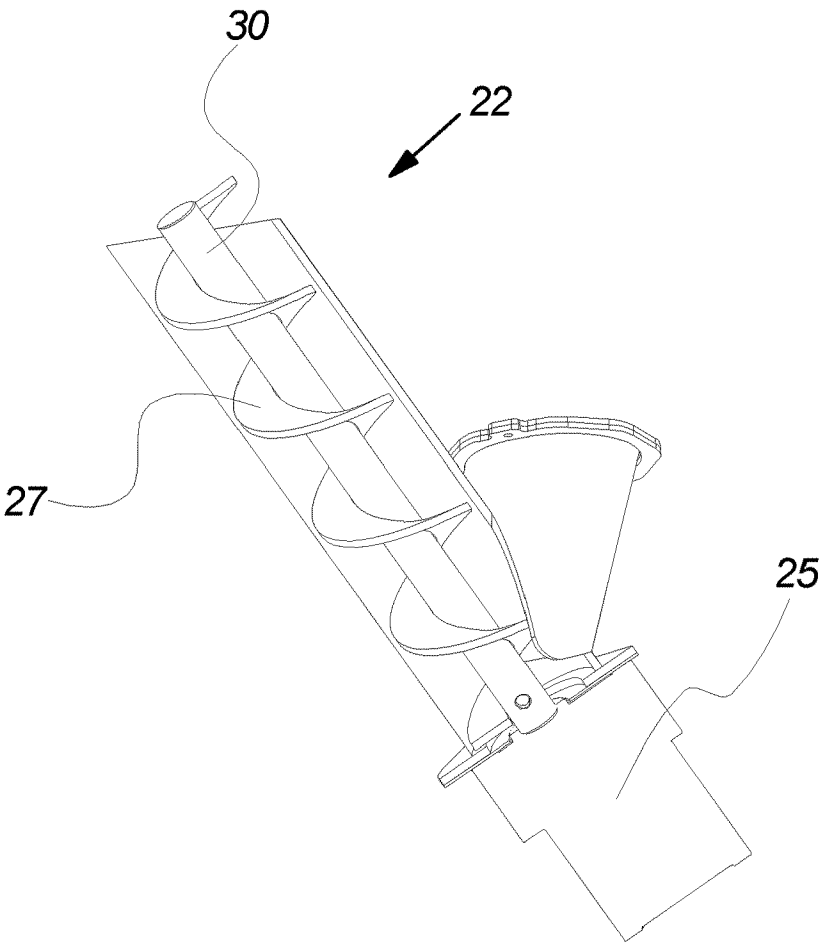
Figure 9:
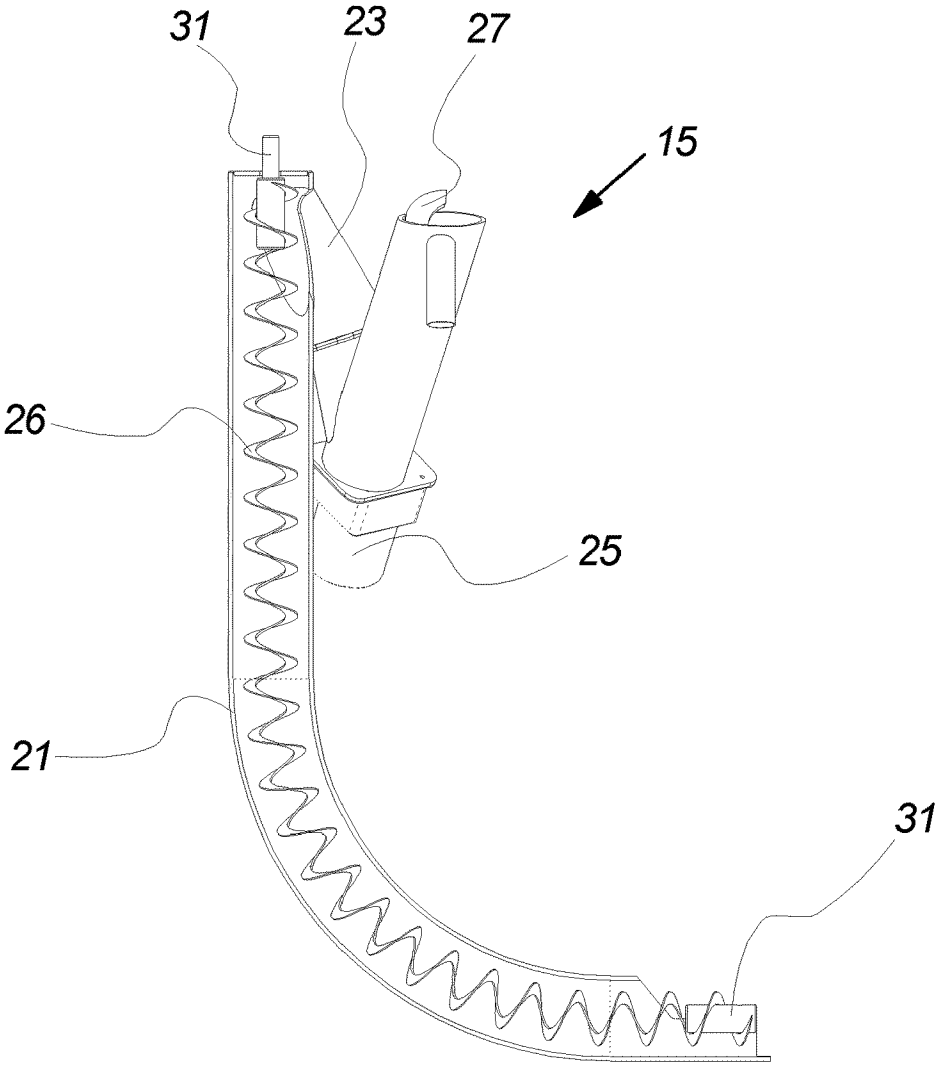

The invention will be described in the following with reference to the figures in which FIG. 1 illustrates a stove shown without front cover, as seen in perspective, FIG. 2 illustrates a stove shown without back cover, as seen in perspective, FIG. 3 illustrates a stove shown without back cover, as seen from the back, FIG. 4 illustrates a cross section through the middle of a stove, as seen from the side, FIG. 5 illustrates a granular material combustion area, as seen in perspective, FIG. 6 illustrates the releasable part of the granular material area sidewall, as seen from in perspective, FIG. 7 illustrates a cross section through the middle of a granular material combustion area, as seen from the side, FIG. 8 illustrates a granular material combustion area, as seen from the top, FIG. 9 illustrates a cross section through a curving auger of the granular material feeding means, as seen in perspective, and FIG. 10 illustrates a cross section through an upper auger of the granular material feeding means, as seen from in perspective.

DETAILED DESCRIPTION

FIG. 1 illustrates a stove 1 shown without front cover, as seen in perspective, FIG. 2 illustrates a stove 1 shown without back cover, as seen in perspective, FIG. 3 illustrates a stove 1 shown without back cover, as seen from the back and FIG. 4 illustrates a cross section through the middle of a stove 1, as seen from the side.

In this embodiment the stove 1 is a combi stove 1 comprises a common combustion chamber 2 in which both logs and granular material can be combusted. However, in another embodiment the stove 1 would be designed to exclusively combust granular material—i.e. a so-called pellet stove.

In this embodiment granular material is combusted in a granular material combustion area 5, which in this case is arranged at the back of the common combustion chamber 2 so that a log combustion area 11 is formed in front of—and partly around—the granular material combustion area 5. However, in another embodiment the granular material combustion area 5 could be placed elsewhere in the common combustion chamber 2, such as a side, at the front, above or under the log combustion area 11 and/or the granular material combustion area 5 could be placed in more locations in the common combustion chamber 2. And physically separating the granular material combustion area 5 from the log combustion area 11 does not limit the respective combustion processes to the respective areas—e.g. logs could easily be placed (or fall onto) the granular material combustion area 5 so that log combustion would also take place in the granular material combustion area 5.

In this embodiment flue means 17 is arranged above the common combustion chamber 2 but in another embodiment the flue means 17 could be arranged next to or even under the common combustion chamber 2.

In this embodiment ash collecting means 3 in the form of an ash draw is arranged under the combustion chamber 2 so that ash generated in the combustion processes in the common combustion chamber 2 fall down into the ash collecting means 3 by means of gravity—e.g. aided by manual sweeping or scraping.

In this embodiment the combustion chamber 2 and the ash collecting means 3 are—at least partly—separated by a grate 12 ensuring that ash may pass while logs and other larger objects remains in the combustion chamber 2.

In this embodiment the stove 1 is also provided with a front aperture 4 through which the combustion chamber 2 may be accessed. The front aperture is so large that logs can pass and thereby be placed in the combustion chamber 2. The front aperture is also used for accessing the granular material combustion area 5 and the log combustion area 11 during cleaning, maintenance, repair and other.

In this embodiment the stove 1 is further provided with a door 19 that can be opened or closed by a user and in this embodiment the door 19 is provided with a window 20 to allow that the combustion processes in the combustion chamber 2 may be seen even when the door 19 is closed.

In this embodiment the stove comprises a granular material storage 16 arranged entirely beneath the combustion chamber 2 and entirely beneath the ash collecting means 3. However, in another embodiment only parts of the granular material storage 16 would be arranged beneath the combustion chamber 2 and/or the granular material storage 16 or parts of the granular material storage 16 could also or instead be arranged next to or above the common combustion chamber 2.

In this embodiment the outer periphery of the granular material storage 16 is also fully enclosed within the outer periphery of the combustion chamber 2 (when seen from the top or the bottom) but in another embodiment the outer periphery of the granular material storage 16 could be substantially equal to the outer periphery of the combustion chamber 2 or at least parts of the granular material storage 16 could extend outside the outer periphery of the combustion chamber 2.

In this embodiment the stove 1 also comprises granular material feeding means 15 arranged for feeding granular material up from the granular material storage 16 and up into the granular material combustion area 5 from beneath. I.e. in this embodiment a helical element 26, 27 of the granular material feeding means 15 will extend substantially all the way up to or even through the granular material feeding aperture 29 in the bottom combustion surface 6 to feed the granular material directly to the granular material combustion area 5 from beneath. However, in another embodiment the helical element 26, 27 would not extend all the way up to the granular material feeding aperture 29 and the granular material would be pushed the rest of the way up to the granular material feeding aperture 29.

In this embodiment the granular material feeding means 15 comprises a curving auger 21 arranged to transport the granular material from the bottom of the granular material storage 16 and up near the common combustion chamber 2 where the granular material falls through a down duct 23 and further into an upper auger 22 arranged to feed the granular material the rest of the way up into the common combustion chamber 2. However, in another embodiment the granular material feeding means 15 would only comprises the curving auger 21, the granular material feeding means 15 would comprise other augers and/or other transport devices or other.

In this embodiment the curving auger 21 is provided with curving auger drive means 24 arranged at the bottom 32 of the granular material storage 16 which is advantageous in that it is significantly colder at the bottom 32 than at the top of the curving auger 21 —due to heat radiation from the neighbouring combustion chamber 2. Furthermore, curving auger drive means 24 arranged at the bottom 32 of the granular material storage 16 it easier to access in case of maintenance or repair. However, in another embodiment the curving auger drive means 24 could also or instead be arranged at the top, at the middle part or even next to the curving auger 21 and then act on the helical element 26 through a chain, a timing belt or other.

Likewise, in this embodiment the upper auger drive means 25 is arranged at the bottom of the upper auger 22 but in another embodiment the upper auger drive means 25 could also or instead be arranged at the top, at the middle part or even next to the upper auger 22 and then act on the helical element 27 through a chain, a timing belt or other.

In this embodiment the curving auger drive means 24 and the upper auger drive means 25 are formed by an electrical motor and a gearbox but in another embodiment the drive means 24, 25 could be formed without a gearbox and/or the drive means 24, 25 could also or instead comprise a pneumatic motor, a hydraulic motor or another type of drive means.

In this embodiment the curving auger drive means 24 and the upper auger drive means 25 are provided with the same electrical motor but with different gearings. Thus, in this embodiment the curving auger 21 is arranged to rotate with about 2.5 rpm while the upper auger 22 is arranged to rotate with about 8.7 rpm. It is advantageous that the upper auger 22 runs faster than the curving auger 21 in that the risk of accumulation of granular material in the upper auger 22 hereby is reduced. Furthermore, the relatively slow rotations reduce noise emission. However, in another embodiment the curving auger 21 and/or the upper auger 22 could be arranged to rotate at another speed and/or one or both could be arranged to rotate with varying speed.

In this embodiment the curving auger 21 and/or the upper auger 22 is arranged to start when granular material is needed in the granular material combustion area 5 and then stop again after a predefined period of time (or when the right amount of granular material has been delivered). But in another embodiment the curving auger 21 and/or the upper auger 22 could be arranged to rotate constantly during the granular material combustion process either at a fixed low speed or adjusting the rotational speed to the demand.

In this embodiment the stove 1 is also provided with airflow generating means 18 arranged for actively generating an airflow up through the bottom airflow apertures 7 (see FIG. 7) and the sidewall airflow apertures 9 (see FIG. 6) during the combustion of granular material in the granular material combustion area 5.

In this embodiment the stove 1 is formed as a vertical cylinder but it is obvious that in another embodiment the stove 1 could also or instead have another more or less varying cross sectional shape such as triangular, square, rectangular, oval, polygonal or other or any combination thereof.

It should be noticed that any orientation reference made throughout this application—such as top, bottom, up, down, side etc.—in made is relation to the stove 1 during normal orientation and use—i.e. when the stove 1 is arranged to efficiently function as a device for emitting heat generated by a combustion process running inside the stove 1.

FIG. 5 illustrates a granular material combustion area 2, as seen in perspective, FIG. 6 illustrates the releasable part 10 of the granular material area sidewall 8, as seen from in perspective, FIG. 7 illustrates a cross section through the middle of a granular material combustion area 5, as seen from the side and FIG. 8 illustrates a granular material combustion area 5, as seen from the top.

In this embodiment, the granular material combustion area 5 is formed integrally with the grate 12 but in another embodiment these parts could be formed completely separate.

In this embodiment, the granular material combustion area 5 comprises a bottom combustion surface 6 having a number of bottom airflow apertures 7 arranged to enable an airflow to the granular material during the combustion process inside the granular material combustion area 5 (see particularly FIG. 7). In this embodiment, the bottom airflow apertures 7 are distributed evenly throughout the bottom combustion surface 6 but in another embodiment the bottom airflow apertures 7 could be arranged differently e.g. a single aperture or only a few apertures, or the bottom airflow apertures 7 could also or instead be the granular material feeding aperture 29 if an upward air flow was generated up through the bottom airflow apertures 7—e.g. up through the upper auger 22, through a leaking connecting between the upper auger 22 and the bottom combustion surface 6 or other.

In this embodiment the granular material combustion area 5 is completely surrounded by a granular material area sidewall 8 which together with the bottom combustion surface 6 forms a burning pot being wider at the bottom than at the top. However, in another embodiment the granular material area sidewall 8 and the bottom combustion surface 6 could be formed in numerous other ways.

In this embodiment a releasable front part 10 of the granular material area sidewall 8 is formed separate and releasable from the granular material combustion area 5 and the rest of the granular material area sidewall 8 so that the granular material combustion area 5, the bottom combustion surface 6 and other may more easily be accessed.

In this embodiment the bottom combustion surface 6 is substantially level with the grate 12 so that when the releasable part 10 of the granular material area sidewall 8 is removed from the granular material area sidewall 8 the bottom combustion surface 6 can easily be cleaned for slag, ash and other and the waste material can easily be swept or pushed out on the grate 12 where it will fall down to the ash collecting means 3.

In this embodiment a bottom part 13 of the releasable part 10 of the granular material area sidewall 8 is provided with a protruding edge arranged to engage a corresponding recess in the bottom combustion surface 6 so that the releasable part 10 of the granular material area sidewall 8 is substantially fixed against displacement in a horizontal plane but can freely be pulled upwards manually and thereby be removed to enable access to the bottom combustion surface 6. However, in another embodiment the releasable part 10 of the granular material area sidewall 8 could be secured against horizontal displacement in relation to the bottom combustion surface 6 in numerous other ways e.g. by means of guide spindles, matching geometry, screws, clamps or other or any combination thereof.

In this embodiment the back part of the granular material area sidewall 8 is formed integrally with the bottom combustion surface 6 so that only around 70% of the bottom combustion surface 6 can be released from the bottom combustion surface 6. But in another embodiment only 60%, 50%, 40% or even less of the granular material area sidewall 8 would be releasable from the bottom combustion surface 6 or 80%, 90% or even 100% of the granular material area sidewall 8 could be releasable from the bottom combustion surface 6.

As best seen in FIG. 6 the releasable part 10 of the granular material area sidewall 8 is in this embodiment provided with sidewall airflow apertures 9 arranged to enable an airflow to the passing flue gasses generated during the combustion process on the bottom combustion surface 6. In this embodiment the sidewall airflow apertures 9 are arranged at the sides along the top edge 14 of the granular material area sidewall 8 but in another embodiment the apertures 9 could also or instead be arranged at the front, further down towards the bottom combustion surface 6 or elsewhere.

As best seen in FIGS. 6 and 7 the fixed back part of the granular material area sidewall 8 is in this embodiment also provided with sidewall airflow apertures 9 and in this embodiment the air flow is guided from the airflow generating means 18 up into the fixed back part of the granular material area sidewall 8 and from there out of the sidewall airflow apertures 9 in the fixed back part and also further on into the releasable part 10 of the granular material area sidewall 8 and thus also out of the sidewall airflow apertures 9. However, it in another embodiment the air flow could be distributed in numerous other ways.

In this embodiment of the invention the top edge 14 of the granular material area sidewall 8 is provided with top edge protrusions 28 ensuring that the top edge 14 is provided with a non-uniform height over the bottom combustion surface 6 so that a log or similar accidentally placed on the granular material combustion area 5 will not hinder or quench the combustion process in the granular material combustion area 5.

FIG. 9 illustrates a cross section through a curving auger 21 of the granular material feeding means 15, as seen in perspective In this embodiment a majority of the curving auger 21 is formed with a centreless helical element 26 enabling that the helical element 26 may rotate even though the auger 21 is curving. But in this embodiment both ends of the helical element 26 is provided with a centre shaft 31. At the bottom the helical element 26 is provided with a shaft part 31 to enable toque transfer from the curving auger drive means 24 and at the top the helical element 26 is provided with a shaft part 31 to suspend the upper end of the helical element 26 of the curving auger 21 and thereby reduce the risk of the helical element 26 scraping against the sidewalls. However, in another embodiment only one end would comprise a shaft 31 or the curving auger 21 would be completely shaftless in its entire length.

In this embodiment the curving auger 21 is arranged to curve from a predominantly horizontal transport direction at the bottom 32 of the granular material storage 16 to a predominantly vertical transport direction.

It is typically almost impossible to use a centreless helical element 26 for transporting granular material vertically or even just at steep angles in that the granular material will fall back down through the centre hole. But in this embodiment the curving auger 21 is formed substantially horizontally at the bottom 32 which is advantageous in that the substantially horizontal part thereby will fill up completely and thereby generate a pressure that will substantially prevent the granular material from running backwards in the vertical part of the curving auger 21.

However, in another embodiment the same effect could be achieved even if the curving auger 21 was sloping at the bottom 32.

In this embodiment the curving auger 21 is arranged to deliver granular material to the upper auger 22 through a down duct 23 to reduce the risk of back burning. However, in another embodiment the curving auger 21 could be arranged to deliver the granular material directly to the upper auger 22 or if the granular material feeding means 15 did not comprise an upper auger 22 (or other granular material transportation devices) the granular material feeding means 15 would not comprise a down duct 23.

FIG. 10 illustrates a cross section through an upper auger 22 of the granular material feeding means 15, as seen from in perspective.

In this embodiment the helical element 27 of the upper auger 22 is provided with a centre shaft 30 extending substantially the full length of the helical element 27 primarily to enable the helical element 27 to feed more or less directly into the granular material combustion area 5 without deforming due to the heat. However, in another embodiment at least parts of the upper auger 22 could be formed without a centre shaft 30.

The invention has been exemplified above with reference to specific examples of stove 1, combustion chamber 2, granular material combustion area 5 and other. However, it should be understood that the invention is not limited to the particular examples described above but may be designed and altered in a multitude of varieties within the scope of the invention as specified in the claims.

LIST

1. Stove
2. Combustion chamber
3. Ash collecting means
4. Front aperture
5. Granular material combustion area
6. Bottom combustion surface
7. Bottom airflow apertures
8. Granular material area sidewall
9. Sidewall airflow apertures
10. Releasable part of granular material area sidewall
11. Log combustion area
12. Grate
13. Bottom part of releasable part
14. Top edge of granular material area sidewall
15. Granular material feeding means
16. Granular material storage
17. Flue means
18. Airflow generating means
19. Door
20. Window
21. Curving auger
22. Upper auger
23. Down duct
24. Curving auger drive means
25. Upper auger drive means
26. Helical element of curving auger
27. Helical element of upper auger
28. Top edge protrusion
29. Granular material feeding aperture
30. Centre shaft
31. Shaft part of curving auger
32. Bottom of granular material storage

The invention claimed is:

1. A stove arranged for combusting granular material, said stove comprising, a granular material combustion area including a bottom combustion surface, granular material feeder arranged for feeding granular material up into said granular material combustion area from a granular material storage arranged beneath said granular material combustion area, wherein said granular material feeder comprises a curving auger, wherein said granular material feeder further comprises a further auger.

2. The stove according to claim 1, wherein said curving auger comprises a centreless helical element.

3. The stove according to claim 1, wherein said curving auger curves from a predominantly horizontal transport direction at a bottom of said granular material storage to a predominantly vertical transport direction.

4. The stove according to claim 1, wherein said curving auger is arranged to deliver granular material to said further auger through a down duct.

5. The stove according to claim 4, wherein a helical element of said further auger is arranged on a centre shaft extending substantially the full length of said helical element.

6. The stove according to claim 1, wherein the outer periphery of said granular material storage is equal to or fully enclosed within the outer periphery of a combustion chamber of said stove as seen in a horizontal plane.

7. The stove according to claim 1, wherein said bottom combustion surface comprises bottom airflow apertures arranged to enable an airflow to said granular material during a combustion of said granular material in said granular material combustion area.

8. The stove according to claim 7, wherein said stove comprises an airflow generator that actively generates an airflow through said bottom airflow apertures at least during a combustion of said granular material.

9. The stove according to claim 1, wherein said stove is arranged for combusting both logs and granular material and wherein said stove comprises a log combustion area.

10. The stove according to claim 9, wherein said stove further comprises a front aperture through which logs may be placed in said log combustion area.

11. The stove according to claim 10, wherein said log combustion area is arranged between said front aperture and said granular material combustion area.

12. The stove according to claim 9, wherein said stove comprises an ash collector arranged under said log combustion area and wherein said log combustion area is separated at least partly from said ash collector by a grate.

13. The stove according to claim 12, wherein said grate and said bottom combustion surface are substantially level.

14. Use of the stove according to claim 1 for combusting wood pellets.

15. The stove according to claim 4, wherein said further auger extends upward from the down duct.

16. The stove according to claim 15, wherein curving auger has a lower end and an upper end, said lower end connected to the granular material storage, said down duct connected at the upper end of said curving auger, and said further auger connected to said down duct and to said granular material combustion area.

17. The stove according to claim 16, wherein said further auger connects to said granular material combustion area through the bottom combustion surface.

* * * * *